US008981194B2

(12) United States Patent
Grossman

(10) Patent No.: US 8,981,194 B2
(45) Date of Patent: Mar. 17, 2015

(54) DRUMSTICK

(71) Applicant: Richard D. Grossman, West Hills, CA (US)

(72) Inventor: Richard D. Grossman, West Hills, CA (US)

( * ) Notice: Subject to any disclaimer, the term of this patent is extended or adjusted under 35 U.S.C. 154(b) by 66 days.

(21) Appl. No.: 13/868,401

(22) Filed: Apr. 23, 2013

(65) Prior Publication Data

US 2014/0311320 A1 Oct. 23, 2014

(51) Int. Cl.

| | |
|---|---|
| ***G10D 3/00*** | (2006.01) |
| ***G10D 13/00*** | (2006.01) |
| ***B27L 9/00*** | (2006.01) |
| ***B27M 3/00*** | (2006.01) |

(52) U.S. Cl.

CPC ..... *G10D 13/003* (2013.01); *B27L 9/00* (2013.01); *B27M 3/0053* (2013.01)

USPC ..... 84/422.4

(58) Field of Classification Search

CPC ..... G10D 13/003

USPC ..... 84/422.4

See application file for complete search history.

(56) References Cited

U.S. PATENT DOCUMENTS

| | | | | |
|---|---|---|---|---|
| 3,958,485 | A * | 5/1976 | Peters | 84/422.4 |
| 7,868,237 | B1 * | 1/2011 | Quilon | 84/422.4 |

* cited by examiner

*Primary Examiner* — Kimberly Lockett

(74) *Attorney, Agent, or Firm* — Albert O. Cota

(57) ABSTRACT

A drumstick that is produced from a pair of bonded wooden halves that form an elongated, structure having a circular bore therethrough. Into the circular bore is inserted a core tube that increases the rigidity of the drumstick, a multiplicity of glass micro-spheres that function to reduce drumstick vibrations that can affect a drummer, and a resilient sleeve that is inserted over the front end and partial rear end of the drumstick. The resilient sleeve increases the useful life of both the drumstick and the instrument struck by the drumstick.

18 Claims, 4 Drawing Sheets

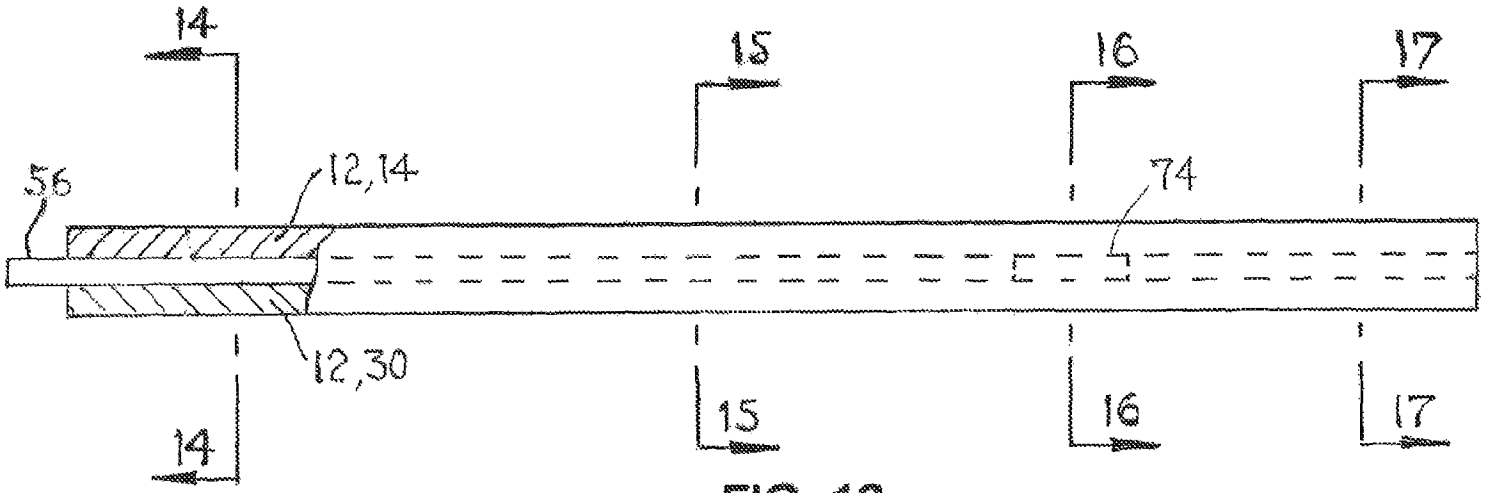
FIG. 12
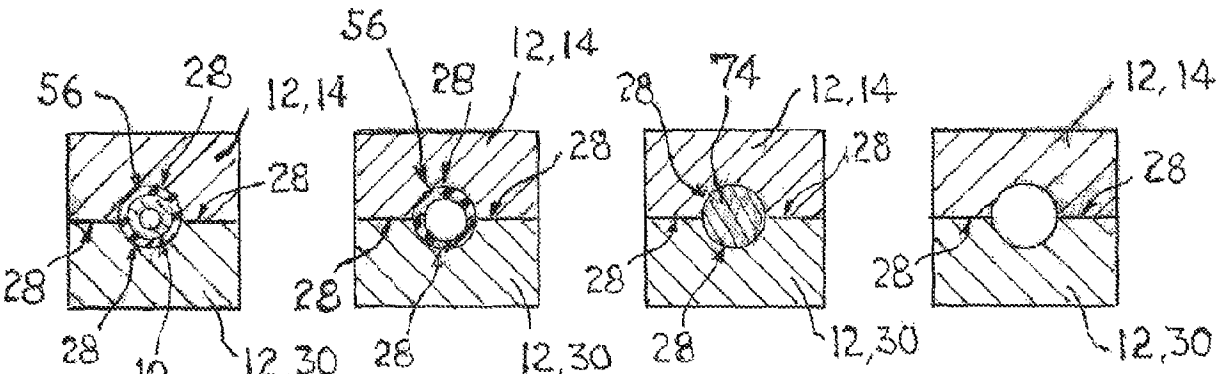
FIG. 14
FIG. 15
FIG. 16
FIG. 17
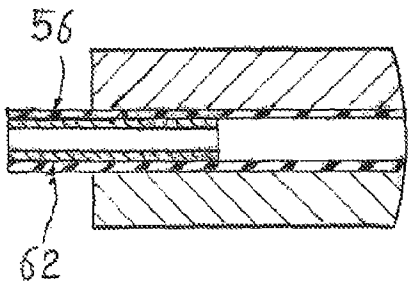
FIG. 13

DRUMSTICK

TECHNICAL FIELD

The invention generally pertains to drumsticks. and more particularly to a drumstick having a core tube, a multiplicity of micro-spheres and a resilient sleeve which function in combination to produce an improved wooden drumstick.

BACKGROUND ART

Most drumsticks are made from solid hickory and maple wood and a minority are made from either tubular aluminum with or without a plastic sleeve located over the major impact zones of the drumstick. The advantages of drumsticks made of wood is that they have that desired "wood feel" which includes light weight and flexural characteristics. The disadvantages of wood are the lack of durability, inconsistent strength and the damage wood causes to cymbals in the transferring of wood particles into the pours in the cymbal's metal. Metal drumsticks having a protective sleeve work well until the cymbal invariably cuts thru the sleeve and causes an impact contact between two metal surfaces causing potential damage to expensive cymbals. Wood also can cause undesirable vibrations and reverberations which are tiring to the drummer.

A search of the prior art did not disclose any literature or patents that read directly on the claims of the instant invention. However, the following U.S. patents are considered related:

| PATENT NO. | INVENTOR | ISSUED |
|---|---|---|
| 3,722,350 | Cordes | 27 Mar. 1973 |
| 3,958,485 | Peters | 25 May 1976 |
| 4,320,688 | Donohoe | 23 Mar. 1982 |
| 4,385,544 | Heiskell | 31 May 1983 |
| 5,179,237 | Grossman | 12 Jan. 1993 |

The U.S. Pat. No. 3,722,350 patent discloses a drumstick comprised of a hollow, cylindrical, metal tube, open at both ends and provided with a straight, cylindrical tip end portion of reduced diameter. A plastic tip is secured to the rear end of the drumstick. A plastic coating or sleeve is disposed along the larger diameter of the cylindrical portion of the drumstick. Variations in the sound characteristics can be achieved by varying the length of the reduced diameter, cylindrical tip portion.

The U.S. Pat. No. 3,958,485 patent discloses a drumstick thrilled from a thermoplastic nylon matrix material and other reinforcing agents such as chopped fiberglass or carbon fibers. The drumstick body is hollow and includes a plurality of longitudinally disposed internal ribs for increasing stiffness and a vibration dampener disposed within to eliminate structural vibrations or reverberations which occur when a drumstick is struck against a solid surface such as the rim of a drum.

The U.S. Pat. No. 4,320,688 patent discloses a synthetic drumstick formed from a central hollow core into which is inserted a flexible tapered stud member. A glass-filled nylon skin is molded over both the central core and the flexible stud member.

The U.S. Pat. No. 4,385,544 patent discloses a drumstick made of flat fabric rolled upon itself repeatedly about a central axis. A material impregnating all of the layers of fabric holds the fabric tribe together.

The U.S. Pat. No. 5,179,237 patent discloses a metal drumstick having a replaceable sheath of plastic material thereon to prevent damage to drums and cymbals. The drumstick is constructed to minimize vibration ordinarily associated with metal drumsticks.

DISCLOSURE OF THE INVENTION

The invention is designed to improve the dynamic playing characteristic of a wooden drumstick or any other type of drumstick and to increase its useful life. In its basic design configuration the inventive drumstick is comprised of:

An elongated structure comprising a first section and a second section. The first section has a front end, a rear end, a radiused outer surface and a flat inner surface, wherein the flat inner surface having a first half of a radiused opening that extends longitudinally. The second section has a front end, a rear end, a radiused outer surface and a fiat inner surface, wherein the flat inner surface having the second half of a radiused opening that extends longitudinally. The second half of the radiused opening is aligned with the first half of the radiused opening to form a longitudinally extending circular bore having a front end and a rear end, A core tube dimensioned to fit into the circular bore. The tube has a front end that extends outward from the front end of the elongated structure and a rear end that extends inward from the rear end of the elongated structure, A drumstick tip having a front radiused surface and a rear flat surface having a tip Cavity that is dimensioned to fit over the front end of the core tube, and A rear cap inserted into the circular bore on the elongated structure.

The drumstick is comprised of two identical half sections that are made from adjacent wood blanks. Both sections have a longitudinal center radius on one face which are then bonded together around a small core tube. The tube, which protrudes outward from the front longitudinal tip end, increases the rigidity of the drumstick. The two half sections produce a rectangular shape that when assembled create a centered bore running the entire longitudinal length of the drumstick. The core tube, which is preferably comprised, of a carbon composite or other high-strength fibers, is bonded in the centered bore to provide strength as a structural member that supports the wood laminate. The core tube can also include an internal metal bushing approximately 1-inch in length that is bonded inside the tip section of the core tube.

Over the outer forward longitudinal section for approximately two-thirds of the drumstick length, starting or the tip end is a pre-molded urethane sleeve. The sleeve is adhesively attached onto the mid-section and the front tapered area. Beyond the front of the sleeve extends the front end of the core tube into which is inserted and bonded a plastic or wooden tip that will not release during use.

At the rear end of the drumstick is located a cavity that is followed by a smaller cavity. The cavity is filled to a specific level with a blend of glass micro-spheres that aid in reducing vibrations. The cavity is then sealed with the rear cap.

In view of the above disclosure the primary object of the invention is to produce a drumstick having a longer useful life and that provides improved playing characteristics while maintaining the feel of a conventional wooden drumstick.

In addition to the primary object of the invention it is also an object of the invention to produce a drumstick that:

- can replace conventional wooden drumsticks,
- provides greater playing comfort for a drummer,
- can be effectively used for an extended period of time compared to a conventional drumstick, and
- is cost effective from a consumer's point of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 12 is an elevational side view of an unfinished wood drumstick showing a core tube protruding from the front end.

FIG. 13 is a partial cross-sectional view showing the placement of a core tube and a metal bushing.

FIG. 14 is a cross-sectional view taken along the lines 14-14 of FIG. 12.

FIG. 15 is a cross-sectional view taken along the lines 15-15 of FIG. 12.

FIG. 16 is a cross-sectional view taken along the lines 16-16 of FIG. 12.

FIG. 17 is a cross-sectional view taken along the lines 17-17 of FIG. 12.

BEST MODE FOR CARRYING OUT THE INVENTION

Figure 1:
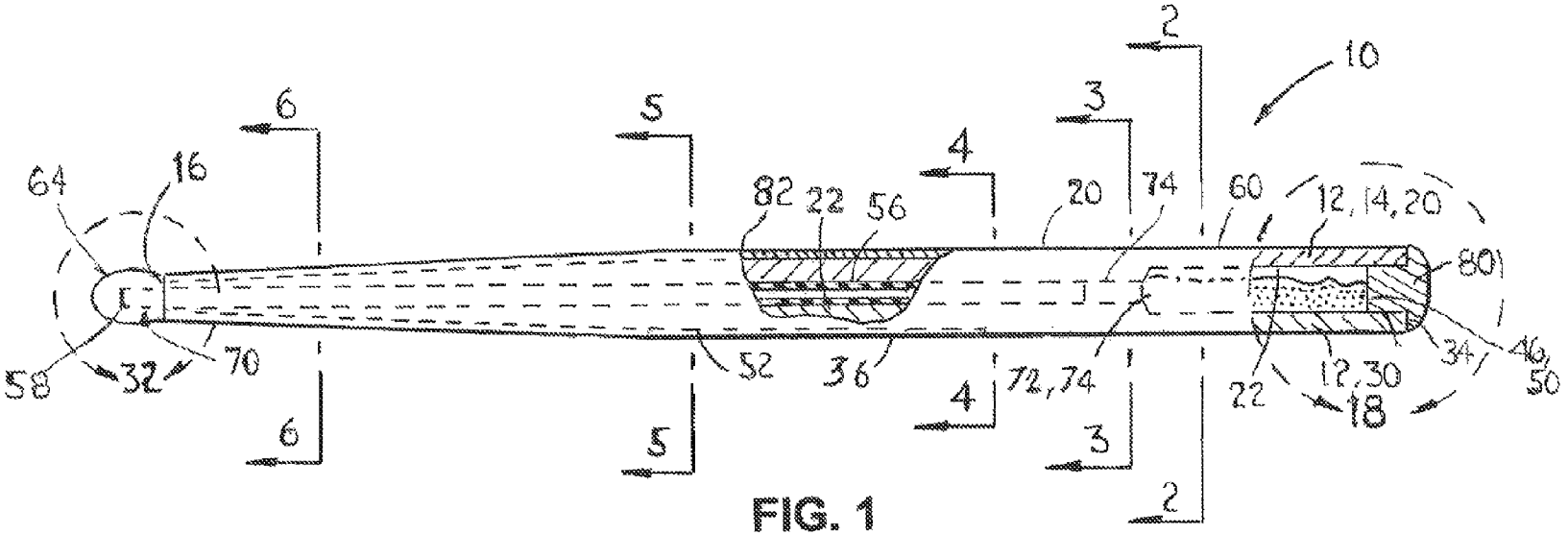
FIG. 1 is an elevational side view of a drumstick having two partial cut-away views.
Figure 2:
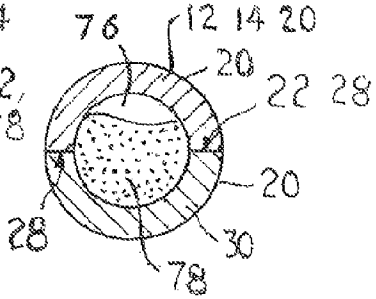
FIG. 2 is a sectional view taken along the lines 2-2 of FIG. 1.
Figure 3:
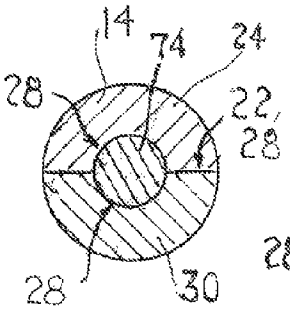
FIG. 3 is a sectional view taken along the lines 3-3 of FIG. 1.
Figure 4:
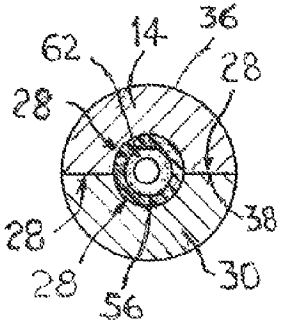
FIG. 4 is a sectional view taken along the lines 4-4 of FIG. 1.
Figure 5:
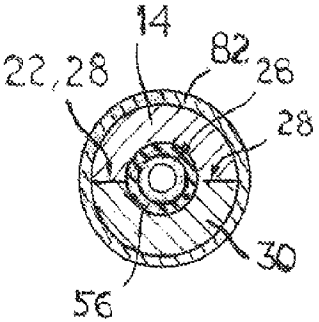
FIG. 5 is a sectional view taken along the lines 5-5 of FIG. 1.
Figure 6:
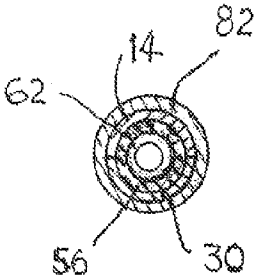
FIG. 6 is a sectional view taken along the lines 6-6 of FIG. 1.
Figure 11:
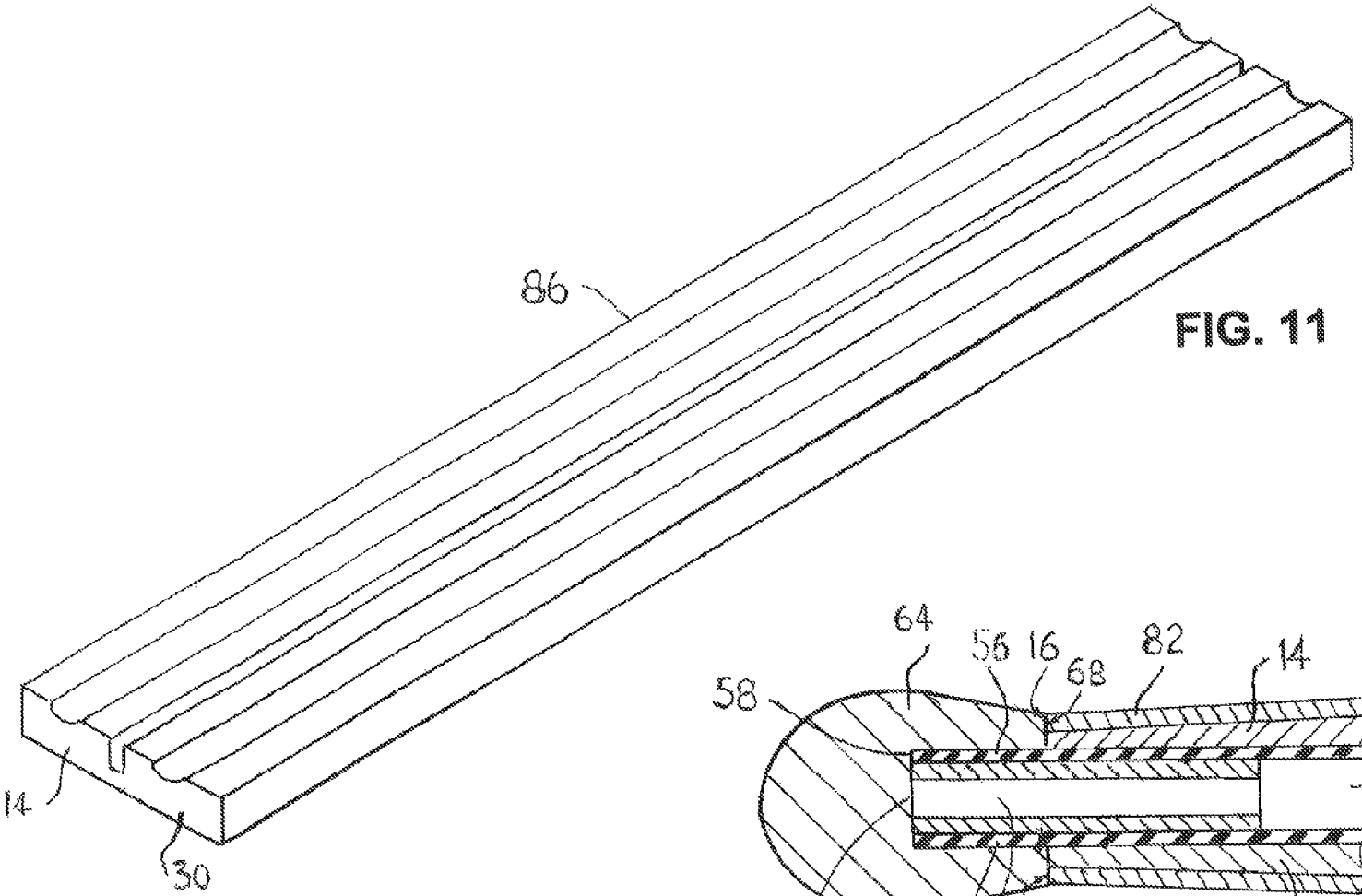
FIG. 11 is an enlarged orthographic top and side view of a wood structure prior to dividing the wood structure into a first section and a second section.

The best mode for carrying out the invention is presented in terms that disclose a preferred embodiment of a drumstick. The preferred embodiment, as shown in FIGS. 1-17, is comprised of the following major elements: the drumstick 10, an elongated structure 12, a core tube 56, a metal bushing 62, a drumstick tip 64, an obstruction 72, a multiplicity of glass micro-spheres 78, a rear cap 80 and a resilient sleeve 82.

The elongated structure 12, as shown in FIGS. 1-17, is comprised of a first section 14 and a second section 30. The first section 14 has a front end 16, a rear end 18, a radiused outer surface 20 and a flat inner surface 22. Extending from the front end 18 is a first cavity 75 followed by a second cavity 76. The flat inner surface 22 has a first half 24 of a radiused opening 26 that extends longitudinally across the elongated structure 12. The elongated structure 12 is made of wood that is preferably selected from the group consisting of hickory, maple and poplar.

The second section 30 has a front end 32, a rear end 34, a radiused outer surface 36 and a flat inner surface 18. The flat inner surface 38 has a second half 40 of a radiused opening 42 that extends longitudinally and that is aligned with the radiused opening 26 on the first section 14 to form a longitudinally extended circular bore 46 having a front end 48 and a rear end 50. The circular bore 46 has a preferred diameter of 0.231 inches. The elongated structure 12, as shown in FIG. 1, tapers inward commencing from its substantial center 52 to the front end 16.

Figure 7:
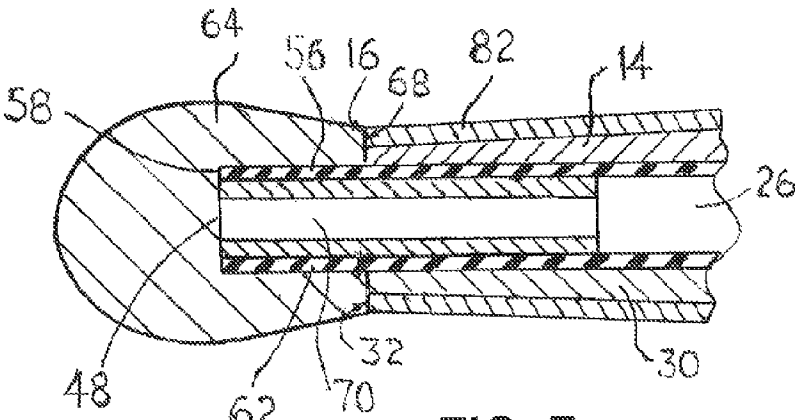
FIG. 7 is an enlarged cross-sectional side view of a drumstick tip inserted over a core tube.
Figure 9:
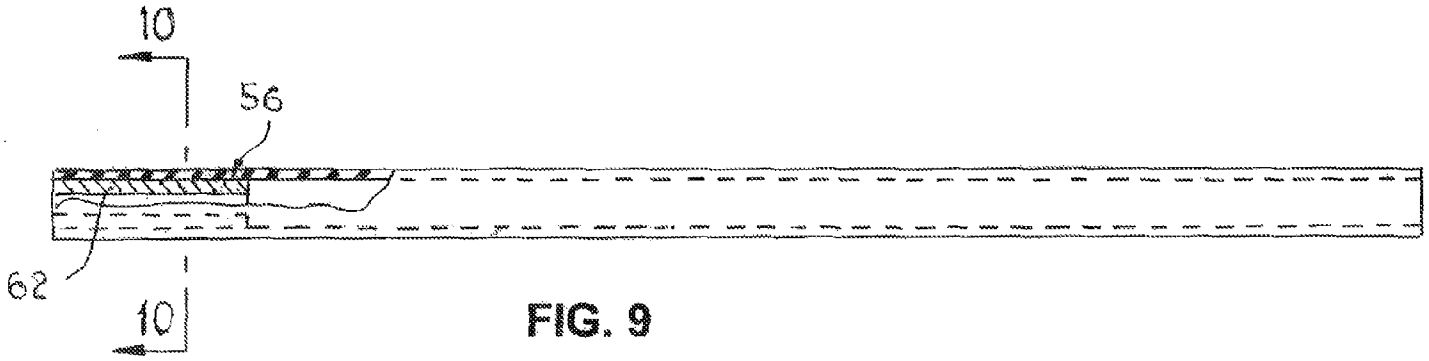
FIG. 9 is an elevational side view showing a cut-away that includes a metal bushing inserted into the core tube.
Figure 10:
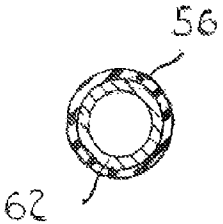
FIG. 10 is an enlarged cross-sectional view taken along the lines 10-10 of FIG. 9.

The core tube 56, as shown best in FIG. 7, is dimensioned to fit into the circular bore 46. The tube 56 has a front end 58 that extends outward from the front end 16 of the elongated structure 12 and a rear end 60 that extends inward from the rear end 18 of the elongated structure 12. The core tube 56 which has a length that ranges from 55-percent to 90-percent of the total length of the elongated structure 12, has a diameter ranging from 0.187 to 0.312 inches and is preferably made of a carbon composite material or other high strength fibers. The care tube 56 is bonded to the circular bore 46 by an adhesive 28. To maintain the rigidity of the core tube 56, and to enhance the structural integrity of the drumstick 10, a metal bushing 62 can be inserted into the front mild 58 of the core tube 56, as shown in FIG. 13.

The drumstick tip 64, as shown in FIGS. 1 and 7, has a front radiused surface 66 and a rear flat surface 68. The rear flat surface 68 has a tip cavity 70 that is dimensioned to fit over the front end 58 of the core tube 56, with the remaining flat surface 68 of the tip 64 interfacing with the front end 16 of the elongated structure 12. The drumstick tip 64 is made of a material selected from the group consisting of a plastic such as NYLON™, DELRIN™ and hardwoods. The tip 64 is attached to the core tube 56 by an adhesive 28.

The obstruction 72, as shown in FIG. 1, is formed within the circular bore 46 adjacent the rear end 60 of the core tube 56. The obstruction 72 can consist of a material that is pressed against the area surrounding the rear end 60 of the core tube 56 or a plug 74 that is inserted into the rear end of the core tube 56. The plug 74 is made of a material selected from the group consisting of cork, rubber, plastic and wood.

Figure 8:
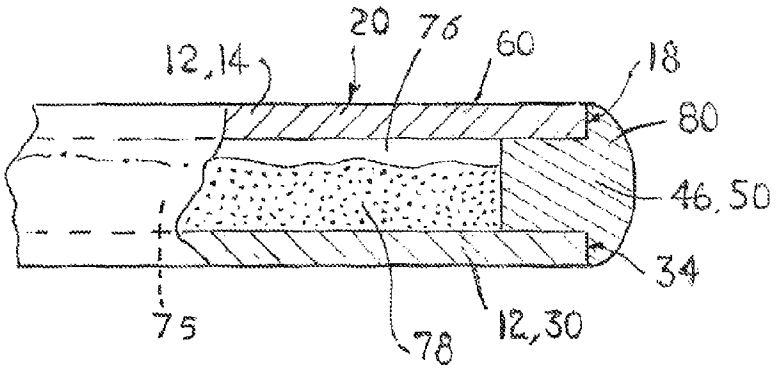
FIG. 8 is an enlarged cross-sectional side view showing a multiplicity if glass microspheres inserted into a larger second cavity.

The multiplicity of glass micro-spheres 78, as shown in FIGS. 1 and 8, are inserted into the second cavity 76 located at the rear end 18 of the elongated structure 12. The spheres 78 have a diameter that ranges from 0.003 inches to 0.30 inches and are designed to reduce drumstick vibrations when the drumstick 10 strikes the edge of any percussion instrument.

The rear cap 80 is dimensioned to he inserted into the circular bore 46 on the elongated structure 12, as shown in FIG. 8. The glass micro-spheres 78 remain captured between the rear cap 80 and the obstruction 72.

The final element that comprises the drumstick 10 is the resilient sleeve 82 that is placed over and bonded onto the radiused outer surface 20 of the elongated structure 12. The sleeve 82 extends from the front end 16 of the elongated structure 12 to a selectable longitudinal length that is typically two-thirds the longitudinal length of the elongated structure 12. The sleeve 82 has a Shore hardness ranging from 90 A to 65 D a wall thickness ranging from 0.030 inches to 0.090 and a length ranging from 7.0 inches to 11.0 inches. The sleeve 82 is bonded to the radiused outer surface 20 of the elongated structure 12 by a urethane based moisture reactive adhesive.

The process for producing the drumstick 10 comprises the following steps:

A. Provide a wood blank 86 having a rectangular cross-section and a length that accommodates the length of the drumstick 10.

B. Produce an elongated structure 12 from the wood blank 86, wherein the elongated structure 12 comprises:

(1) a first section 14 having a front end 16, a rear end 18, and a first half 24 of a radiused opening 26 that extends longitudinally across said elongated structure 12, (2) a second section 30 having a front end 32, a rear end 34, and a second half 40 of a radiused opening 42 that extends longitudinally and that is aligned with the first half 24 of the radiused opening 26 on the first section 14 to form a longitudinally extending circular bore 46, having a front end 48 and a rear end 50, C. Insert a metal bushing 62 into the front end 58 of the core tube 56, D. Apply an adhesive 28 to the first section 14 and to the second section 30, E. Place the core tube 56 into the radiused opening 36 of the second section 30, F. Place the first section 14 over the second section 30 and clamp the two sections together for at least sixty minutes, G. Profile a diameter over the rectangular area of the first section 14 and the second section 30, H. Bond a resilient sleeve 82 over the profiled diameter, I. Attach a drumstick tip 64 over the front end 58 of the core tube 56, J. Coat the handle area of the drumstick 10 with lacquer or urethane, K. Cut the handle area of the drumstick 10 to a selectable length, L. Produce a larger cavity 76 that extends from the rear end 18 of the drumstick 10, M. Fill the larger cavity 76 with a selectable quantity of glass micro-spheres 78, and N. Bond a rear cap 80 to the rear end 18 of the drumstick 10.

While the invention has beer described in detail and pictorially shown in the accompanying drawings it is not to be limited to such details, since many changes and modification may be made to the invention without departing from the spirit and the scope thereof. Hence, it is described to cover any and all modifications and forms which may come within the language and scope of the claims.

The invention claimed is:

1. A drumstick comprising:

a) an elongated structure comprising:

(1) a first section having a front end, a rear end, a radiused outer surface and a flat inner surface, wherein the flat inner surface having a first half of a radiused opening that extends longitudinally, (2) a second section having a front end, a rear end, a radiused outer surface and a flat inner surface, wherein the flat inner surface having a second half of a radiused opening that extends longitudinally and that is aligned with the first half of the radiused opening on the first section to form a longitudinally extending circular bore having a front end and a rear end, b) a core tube dimensioned to fit into the circular bore, said tube having a front end that extends outward from the front end of said elongated structure and a rear end that extends inward from the rear end of said elongated structure, c) a drumstick tip having a front radiused surface and a rear flat surface having a tip cavity that is dimensioned to fit over the front end of said core tube, and d) a rear cap dimensioned to be inserted into the circular bore on said elongated. structure.

2. The drumstick as specified in claim I wherein said elongated structure is made of wood that is selected from the group consisting of hickory, maple and poplar.

3. The drumstick as specified in claim 2 further comprising a metal bushing inserted into the front end of said core tube.

4. The drumstick as specified in claim 1 further comprising an obstruction located adjacent the rear end of said core tube.

5. The drumstick as specified in claim 4 further comprising a multiplicity of micro-spheres inserted into the space created by said obstruction and said rear cap, wherein said micro-spheres are made of glass and have a diameter ranging from 0.003 to 0.30 inches.

6. The drumstick as specified in claim 2 further comprising a resilient sleeve that is placed over the outer surface of said elongated structure.

7. A drumstick comprising:

a) an elongated structure comprising:

(1) a first half having a front end, a rear end, a radiused outer surface and a flat inner surface, wherein the flat inner surface having a first half of a radiused opening that extends longitudinally, (2) a second half having a front end, a rear end, a radiused outer surface and a flat inner surface, wherein the flat inner surface having a second half of a radiused opening that extends longitudinally and that is aligned with the radiused opening on the first half to form a longitudinally extending circular bore having a front end and a rear end, wherein extending from the front end is a first cavity followed by a second cavity, wherein said elongated structure tapers inward commencing from its substantial center to the front end, b) a core tube dimensioned to fit into the circular bore, said tube having a front end that extends outward from the front end of said elongated structure and a rear end that extends inward from the rear end of said elongated structure, c) a metal bushing inserted into the front end of said core tube, d) a drumstick striking tip having a front radiused surface and a rear flat surface, wherein the rear flat surface having a tip cavity that is dimensioned to fit over the front end of said core tube, with the remaining flat surface of said tip interfacing with the :front end of said elongated structure, e) an obstruction located adjacent the rear end of said core tube, f) a multiplicity of glass micro-spheres inserted into the second cavity located on said elongated structure, g) a rear cap dimensioned to be inserted into the second cavity located on said elongated structure, wherein said glass micro-spheres remain captured between the space created between said rear cap and the obstruction, and h) a resilient urethane sleeve that is placed over and bonded onto the radiused outer surface of said elongated structure, wherein said sleeve extends from the front end of said. elongated structure to a selectable longitudinal length of said elongated structure.

8. The drumstick as specified in claim 7 wherein said elongated structure is made of wood, that is selected from the group consisting of hickory, maple and poplar.

9. The drumstick as specified in claim 4 wherein the circular bore has a diameter that accepts the diameter of said core tube.

10. The drumstick as specified in claim 7 wherein said core tube is made of a carbon composite material and other high-strength fibers.

11. The drumstick as specified in claim 10 wherein said core tube is bonded to the circular bore by an adhesive.

12. The drumstick as specified in claim 7 wherein the drumstick striking tip is made of a material selected from the group consisting of plastic and hardwoods.

13. The drumstick as specified in claim 12 wherein said drumstick striking tip is bonded to said core tube by an adhesive.

14. The drumstick as specified in claim 7 wherein said core tube has a length that ranges from 55 percent to 90 percent of the total length of said elongated structure.

15. The drumstick as specified in claim 7 wherein said obstruction is comprised of an internal plug is made of a material selected from the group consisting of cork, rubber, plastic and wood.

16. The drumstick as specified in claim 7 wherein said resilient sleeve has a Shore hardness ranging from 90A to 65D, a wall thickness ranging from 0.030 inches to 0.090 inches and a length ranging from 7.0 inches to 11.0 inches.

17. The drumstick as specified in claim 16 wherein said resilient sleeve is bonded to the outer surface of said elongated structure by an adhesive.

18. A process for producing a drumstick comprising the following steps:

a) provide a wood blank having a rectangular cross-section and a length that accommodates the length of the drumstick, b) produce an elongated structure from the wood blank, said elongated structure comprising:

(1) a first section having a front end, a rear end, and a first half of a radiused opening that extends longitudinally across said elongated structure, (2) a second section having a front end, a rear end, and a second half of a radiused opening that extends longitudinally and that is aligned with the first half of the radiused opening on the first section to form a longitudinally extending circular bore, having a front end and a rear end, c) insert a metal bushing into the front end of the core tube, d) apply an adhesive to the first section and to the second section, e) place the core tube into the radiused opening of the second section, f) place the first section over the second section and clamp the two sections together for at least sixty minutes, g) profile a diameter over the rectangular area of the first section and the second section, h) bond a resilient sleeve over the profiled diameter, i) attach a drumstick tip over the front end of the core tube, j) coat the handle area of the drumstick with lacquer or urethane, k) cut the handle area of the drumstick to a selectable length, l) produce a larger cavity that extends from the rear end of the drumstick, m) fill the larger cavity with a selectable quantity of glass micro-spheres, and n) bond a rear cap to the rear end of the drumstick.

* * * * *